US005131200A

United States Patent [19]

McKinnon

[11] Patent Number: 5,131,200

[45] Date of Patent: Jul. 21, 1992

[54] ROOF SYSTEM

[76] Inventor: Gordon McKinnon, 119 S. Oregon Ave., Tampa, Fla. 33606

[21] Appl. No.: 397,588

[22] Filed: Aug. 23, 1989

[51] Int. Cl.[5] ..... E04D 1/00

[52] U.S. Cl. ..... 52/536; 52/518; 52/555; 52/588

[58] Field of Search ..... 52/536, 537, 538, 528, 52/529, 541, 542, 555, 588, 518, 728

[56] References Cited

U.S. PATENT DOCUMENTS

| | | | |
|---|---|---|---|
| 44,675 | 10/1864 | Straub . | |
| 511,506 | 12/1893 | Cheeseman | 52/542 X |
| 1,513,940 | 11/1924 | Smith et al. | 52/518 |
| 2,317,583 | 4/1943 | Bolen et al. | 52/467 X |
| 3,122,073 | 2/1964 | Masse . | |
| 3,134,464 | 5/1964 | Markle . | |
| 3,280,528 | 10/1966 | Dunlap, Jr. | 52/309 |
| 3,292,334 | 12/1966 | Craig | 52/516 |
| 3,389,518 | 6/1968 | Horbach | 52/309 |
| 3,483,664 | 12/1969 | Funk et al. | 52/309 |
| 3,736,715 | 6/1973 | Krumwiede | 52/309 |
| 4,031,683 | 6/1977 | Walker | 52/536 |
| 4,059,933 | 11/1977 | Funk et al. | 52/467 X |
| 4,160,346 | 7/1979 | Kaufman | 52/96 |
| 4,251,967 | 2/1981 | Hoofe, III | 52/555 X |
| 4,430,463 | 2/1984 | Mullenax | 428/500 X |
| 4,491,608 | 1/1985 | Thygesen | 52/516 X |
| 4,530,193 | 7/1985 | Ochs | 52/408 |
| 4,580,389 | 6/1986 | Freiborg | 52/96 X |
| 4,601,150 | 7/1986 | Dougherty | 52/309.12 |
| 4,603,517 | 8/1986 | Lyons, Jr. | 52/60 |
| 4,624,082 | 11/1986 | Mansfield | 52/11 |
| 4,677,800 | 7/1987 | Roodvoets | 52/309.12 |
| 4,680,909 | 7/1987 | Stewart | 52/409 |

OTHER PUBLICATIONS

*Adhesives in Building Construction*, U.S. Dept. of Agriculture, Handbook #516, Feb. 1978, pp. 21–28.

*Primary Examiner*—David A. Scherbel
*Assistant Examiner*—Linda J. Watson

[57] ABSTRACT

An apparatus is disclosed for an improved roofing covering for affixing to a roof structure. The apparatus comprises a plurality of rigid base members, each being substantially rectangular and having a first side and a second side and a top end and a bottom end. A groove is disposed on each of the first sides of each of the plurality of base members and a tongue is disposed on each of the second sides of base members. A recess is disposed on each of the bottom ends of the base members and a projection is disposed on each of the top ends of the base members. The base members are affixed to the roof structure. A groove of at least one of the base members engages a tongue of an adjacent base member and a projection of at least one of the base members engages a recess of an adjacent base member. A coating overlaying the base members is applied following affixing to the roof structure for the purpose of sealing the tongue and groove engagements and the projection and recess engagements between adjacent base members and to provide protection to the exterior surfaces of the base members.

10 Claims, 5 Drawing Sheets

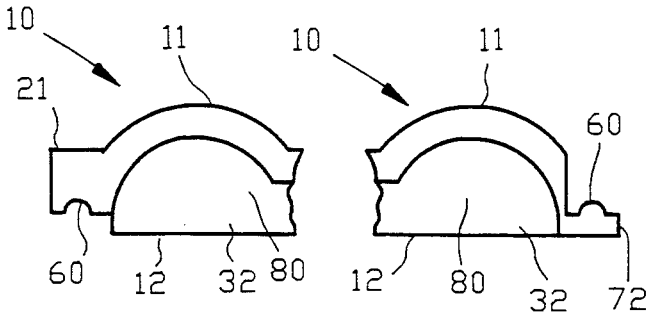
FIG. 6
FIG. 7
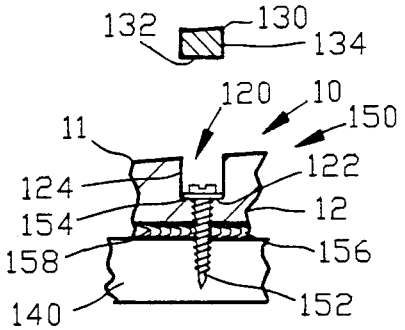
FIG. 8
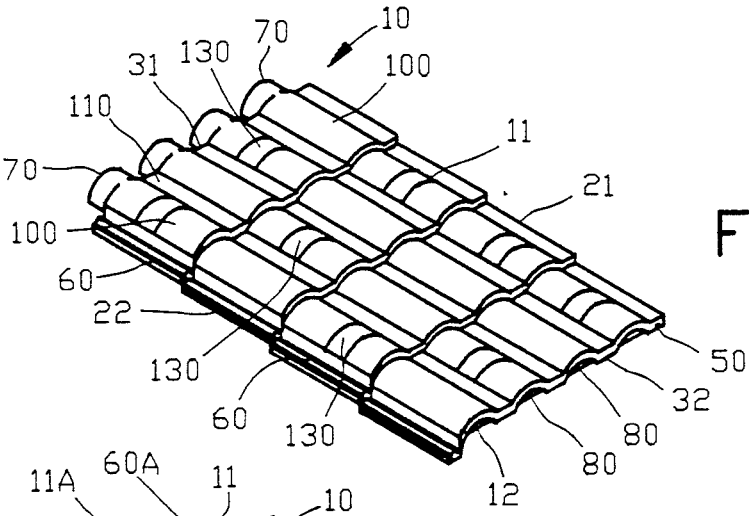
FIG. 9
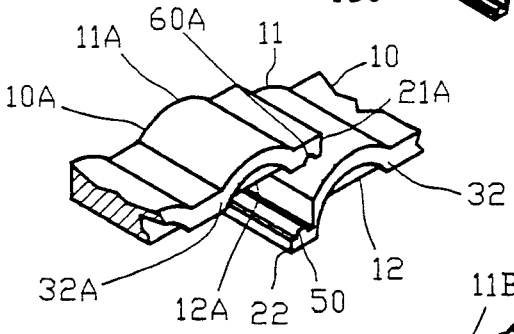
FIG. 10
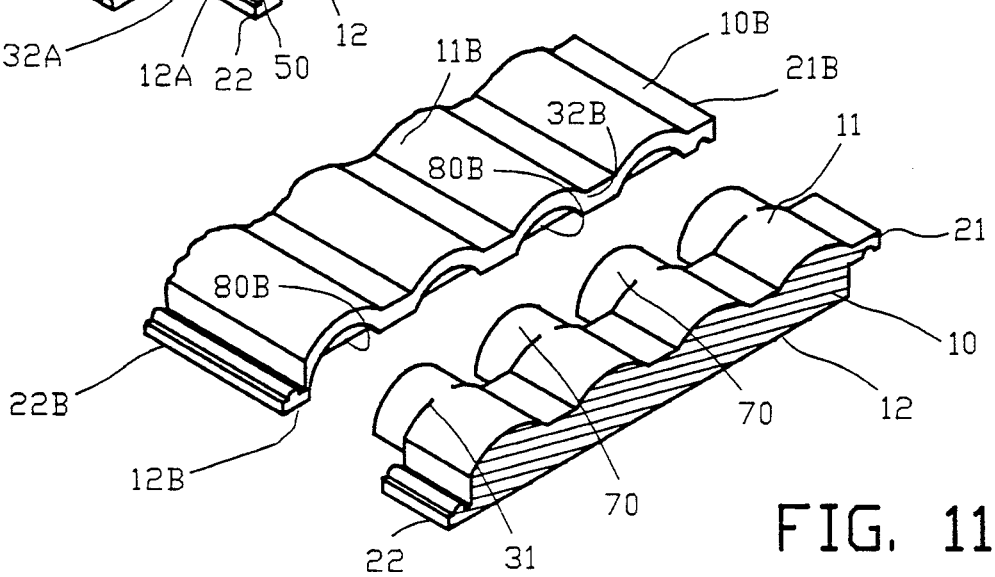
FIG. 11

ROOF SYSTEM

BACKGROUND OF THE INVENTION

1. Field of the Invention

This invention relates to an improved roofing system, and more particularly to a roofing system utilizing a plurality of overlapping and interlocking modular rigid base members affixed to an existing roof structure and coated with a weather resistant coating.

2. Information Disclosure Statement

The problems associated with the construction of durable weather resistant roof covering are well known to those skilled in the art. Weather resistance is the primary purpose of any roofing system. The establishment of a roofing system capable of maintaining substantial integrity when exposed to the wide variety of atmospheric and meteorological considerations has proved to be a basic problem. Providing a long term useful service life to a roofing system requires that durability be an important consideration in the design and construction of the roofing system as well as in the selection of raw materials and component parts. Some roofing systems have attempted to solve both the weather integrity and long term durability problems through the utilization of heavy materials similar to concrete, clay tile and the like. Although these roofing systems provided some solutions, they also produced new problems relative to roof and building structure bracing and construction. These considerations also preclude the use of these roofing systems as replacement roofs. The thermal insulation characteristics of a roofing system have always been a desirable le factor, but since energy conservation has become an issue and the costs of energy for both heating and cooling have increased substantially, the thermal insulation factor has risen to greater prominence. Likewise, some excellent roofing systems are extremely labor intensive in that field fabrication requires skilled workers expending considerable time periods per unit area of the completed roof. As labor costs increase, these roofing systems become cost prohibitive.

A wide variety of roofing systems have been produced which have solved some of these problems, as is well known to those skilled in the art, but no single roofing system has been developed which addresses all of the stated problems.

U.S. Pat. No. 4,624,082 to Mansfield teaches the use of a reusable grid for in-place casting of a monolithic roof system for a sloped roof.

U.S. Pat. No. 3,292,334 to Craig teaches the construction and use of a roofing element and roof system utilizing a bonded glass mat component affixed to a roof structure and coated with an aqueous clay containing asphalt emulsion.

U.S. Pat. No. 4,160,346 to Kaufman teaches a roofing system having an insulating blanket of plastic foam covered by a sheath made up of a shell of reinforced concrete covered by a weather impervious rubbery textured membrane.

U.S. Pat. No. 4,530,193 to Ochs teaches a roofing system built up by affixing an insulating layer of closed cell polystyrene insulated panels over the entire roof. A water impermeable membrane is laid loosely over all the insulation and a protective layer of extruded foamed closed cell polystyrene protective panels are installed over the membrane.

U.S. Pat. No. 4,601,150 to Dougherty teaches a roofing panel comprising a layer of closed cell foam and a layer of mortar with a reinforcing grid disposed within the mortar.

U.S. Pat. No. 4,680,909 to Stewart teaches a roofing system comprising a plurality of prefabricated panels and spacers. The panels comprise a base member and a laminar covering which overlaps the base on an end and underlaps the base on both side edges, enabling the laminate from a first panel to overlap the base member of a second panel. Spacers are installed adjacent to the panel sides. A closure is subsequently placed over the spacers and sealed by the addition of heat.

U.S. Pat. No. 4,677,800 to Roodvoets teaches a roofing system wherein a waterproof membrane is applied to the roof sheathing and extruded closed cell polystyrene foam panels are provided on top of the membrane. The top surface of the panels is provided with a plurality of ribs and grooves. Precast lightweight reinforced concrete panels containing a plurality of holes are adhesively fastened to the extruded foam panels by an adhesive placed along the foam panel ribs. The concrete panels are disposed to the foam panels providing substantial alignment of the holes with the grooves in the foam panels to provide for ventilation and moisture removal on hot days.

Although these and other devices have enhanced the art, none has satisfactorily addressed the problem, and significant enhancements are still needed. A review of the teachings of the aforesaid roofing systems verifies the need for a single roofing system which provides weather integrity, durability, minimal field labor intensity, is light weight, and provides substantial thermal insulation.

Therefore, it is an object of the present invention to provide an improved roof system.

Another object of this invention is to provide an improved roof system which is substantially impervious to weather effects.

Another object of this invention is to provide an improved roof system capable of withstanding long term degradation effects of weather.

Another object of this invention is to provide an improved roof system which is easily applied, requiring minimal field installation time, and low to moderate skill levels.

Another object of this invention is to provide an improved roof system which provides a high degree of weather protection and durability, while remaining light in weight, allowing installation on new or existing structures without the need for roof and support structure redesign or support enhancement.

Another object of this invention is to provide an improved roof system comprising a high degree of thermal insulating properties.

Another object of this invention is to provide an improved selection of variations in the appearance of the completed roofing system, enabling the roofing system in the present invention to be effectively utilized in a wide variety of architectural styles.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention within the scope of the invention. Accordingly other a fuller understanding of the objects of the invention may be had by referring to the summary of the invention, the detailed description describing the preferred embodiment, in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved method and apparatus for a roofing covering for affixing to a roof structure. The apparatus comprises a plurality of rigid base members, each being substantially rectangular and having a first side and a second side and a top end and a bottom end. A groove is disposed on each of the first sides of each of the plurality of base members, and a tongue is disposed on each of the second sides of base members. A recess is disposed on each of the bottom ends of the base members, and a projection is disposed on each of the top ends of the base members. The base members are affixed to the roof structure with a groove of at least one of the base members engaging a tongue of an adjacent base member and a projection of at least one of the base members engaging a recess of an adjacent base member. Following affixing of the base members to the roof structure, a coating overlaying the base members is applied for the purpose of sealing the tongue and groove engagements and the projection and recess engagements between adjacent base members and to provide protection to the exterior surfaces of the base members.

In a more specific embodiment of the invention, the apparatus comprises a plurality of rigid base members, wherein each of the base members comprises a core member and a plurality of surface members affixed to the core member at a surface interface, and a plurality of rigid stringers, having a plurality of perforations, interposed between the core member and the surface members at the surface interface. The plurality of surface members comprises cavities positioned adjacent to the plurality of perforations in the rigid stringers. A plurality of mechanical fasteners are positioned in the cavities and extend through the perforations in the rigid stringers, through the core member, and into the roof structure for the purpose of affixing the base member to the roof structure. Sealing the cavities in the base members is accomplished using a plurality of mating plugs disposed within the plurality of cavities. Preferably, each of the base members comprises an expanded closed cell plastic foam having an exposed surface pattern emulating a tile roof or a traditional shingle roofing system. Preferably, the coating overlaying the plurality of base members comprises a modified pigmented concrete material.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which:

FIG. 6 is an enlarged view of a portion of FIG. 2 showing a groove coupling;

FIG. 7 is an enlarged view of a portion of FIG. 2 showing a tongue coupling;

FIG. 8 an enlarged partial cross sectional view of the base member affixed to a roof structure with a mechanical fastening means;

FIG. 9 is an enlarged isometric view of the first embodiment of a base member of the improved roof system of the present invention;

FIG. 10 is an enlarged exploded view of plural base members of the first embodiment with a cooperating tongue and groove;

FIG. 11 is an enlarged exploded view of plural base members of the first embodiment with a cooperating projection and recess;

FIG. 15 is a side view of FIG. 14A;

Similar reference characters refer to similar parts throughout the several FIGS. of the drawings.

DETAILED DESCRIPTION

Figure 1:
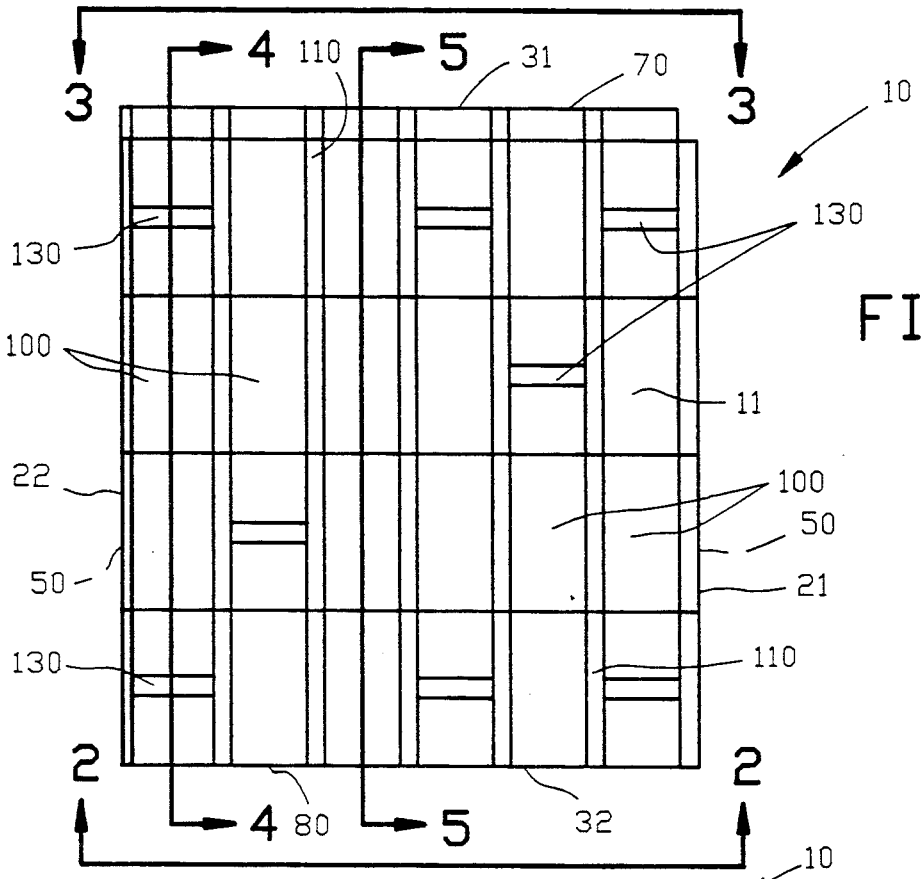
FIG. 1 is a plan view of a first embodiment of a base member of the improved roof system of the present invention.
Figure 2:
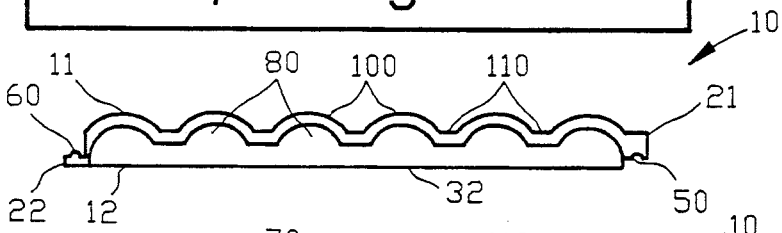
FIG. 2 is a view along line 2—2 in FIG. 1.
Figure 3:
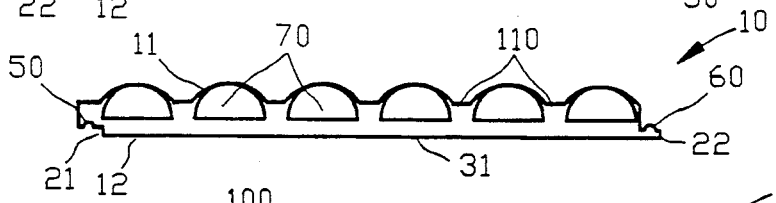
FIG. 3 is a view along line 3—3 in FIG. 1.
Figure 4:
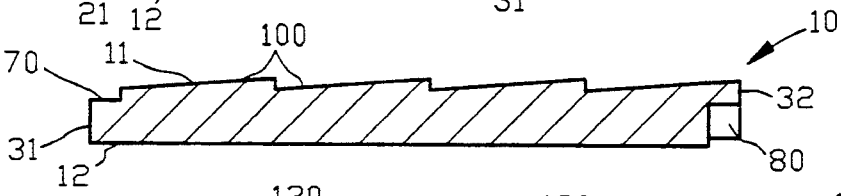
FIG. 4 is a view along line 4—4 in FIG. 1.
Figure 5:
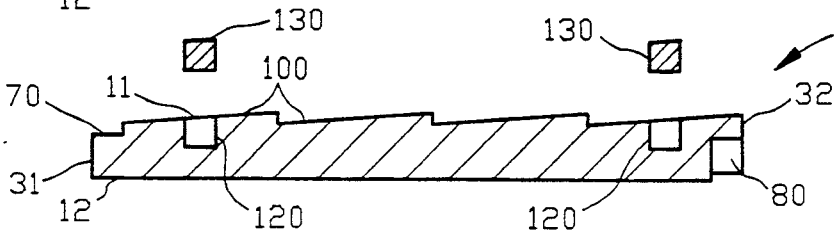
FIG. 5 is a view along line 5—5 in FIG. 1.

FIG. 1 is a plan view of a first embodiment of a rigid base member 10 of the improved roof system of the present invention. The base member 10 is shown having a top surface 11 and a bottom surface 12. The base member 10 further comprises a first side 21 and a second side 22 and a top end 31 and a bottom end 32. A groove 50 is disposed on the first side 21 of the rigid base member 10 whereas a tongue 60 is disposed on the second side 30 of the rigid base member 10 as shown in FIGS. 2 and 3. The rigid base member 10 further defines a plurality of projections 70 disposed on the top end 31 of base member 10 and a plurality of recesses 80 located adjacent to the bottom end 32 of the base member 10 as shown in FIGS. 4 and 5.

The top surface 11 of the base member 10 which is exposed during normal use includes a plurality of partially cylindrical tile emulators 100 which are located adjacent to a plurality of planar areas 110 for simulating a plurality of tiles of a conventional tile roof. Preferably, the rigid base member 10 is molded of a light weight insulating material such as an expanded closed cell plastic foam such as styrofoam or the like. Accordingly, the rigid base member 10 may be molded in large sections such as four feet by four feet or larger to facilitate the installation of a plurality of rigid base members 10 upon a roof structure as will be hereinafter described. Furthermore, since the rigid base member 10 is molded of a light weight insulating material, a simulated tiled roof may be installed on a roof structure that was not specifically designed or specifically reinforced for supporting the weight of a conventional tiled roof.

FIG. 2 is an elevational view along line 2—2 in FIG. 1, showing the plurality of recesses 80 located at the bottom end 32 of the base member 10. The plurality of tile emulators 100 are shown as curved or partially cylindrical tiles adjacent to the plurality of planar areas 110, but it should be understood that flat tiles may be equally suitable for use with the present invention. The groove 50 as also shown in an enlarged partial view of FIG. 6, is located adjacent to the first side 21 of base member 10 and is disposed to face downwardly in FIGS. 2 and 6 whereas the tongue 60 as also shown in an enlarged partial view of FIG. 7 is located adjacent to the second side 22 of base member 10 and is disposed to face upwardly in FIGS. 2 and 7.

FIG. 3 is an elevational view along line 3—3 in FIG. 1, wherein the plurality of projections 70 are located adjacent to the top end 31 of the base member 10. The groove 50 disposed adjacent to the first side 21 and the tongue 60 disposed adjacent to the second side 22 of base member 10 are adapted to interlock with a tongue 60 and a groove 50, respectively, of adjacent base members 10 of identical design to form the roof structure as will be described in greater detail hereinafter. The groove 50 and the tongue 60 are integrally formed with the base member 10 and extend along the entire first and second sides 31 and 32 of the base member 10.

FIG. 4 is a sectional view along line 4—4 in FIG. 1 wherein the rigid base member 10 is shown in cross-section as a solid one piece or unitary structure. The plurality of recesses 80 located at the bottom end 32 of the base member 10 and the plurality of projections 70 located adjacent to the top end 31 of the base member 10 are adapted to cooperate or interlock with the projections 70 and recesses 80, respectively, of an adjacent base member 10 of identical design to form the roof structure.

FIG. 5 is a sectional view along line 5—5 in FIG. 1, wherein base member 10 is shown in cross-section with a plurality of cavities 120 defined in selected ones of the tile emulators 100 of the rigid base member 10. Each of the plurality of cavities 120 extend from the top surface 11 only partially through the base member 10 and define a bottom cavity surface 122 and cavity sidewalls 124. The plurality of cavities 120 are preferably preformed in the selected ones of the tile emulators 100 of the rigid base member 10 during the molding of the rigid base member 10. A plurality of mating plugs 130 are formed for insertion within the plurality of cavities 120 defined in the rigid base member 10. Each of the plurality of mating plugs 130 define a plug bottom surface 132 and plug sidewalls 134 with the plug sidewalls 134 fictionally engaging the cavity sidewalls 124 of the plurality of cavities 120 when the plug bottom surface 132 of the plurality of mating plugs 130 engages with the bottom cavity surfaces 122 of the plurality of cavities 120. The plurality of mating plugs 130 are shown in FIG. 5 prior to insertion into the plurality of cavities 120.

FIG. 8 is an enlarged partial cross sectional view of a base member 10 affixed to a roof structure 140. In this embodiment, a mechanical fastening means 150 comprising a screw 152 and a washer 154 with the screw penetrating through the base member 10, an adhesive 156, a vapor impermeable membrane 158 to be secured into the roof structure 140. Preferably, the bottom surface 12 of the rigid base member 10 is adhesively affixed to the roof structure 140 or to the optional intermediate vapor impermeable membrane 158. The rigid base member 10 is also affixed to the roof structure 140 through the screw penetrating through the base member 10 and being secured to the roof structure with washer 154 engaging the bottom cavity surface 122 of the cavity 120. The mating plug 130 is then disposed within cavity 120 after the base member 10 is affixed to roof structure 140.

FIG. 9 is an isometric detail view of the first embodiment of the rigid base member 10 of the improved roof system of the present invention, illustrating the plurality of tile emulators 100 disposed adjacent a plurality of planar areas 110. FIG. 9 also illustrates the plurality of projections 70 disposed along the top end 31 and the plurality of recesses 80 disposed along the bottom end 32 of the base member 10.

FIG. 10 is an isometric exploded view of the tongue 60 of a first base member 10 and groove 50A of a second base member 10A disposed immediately prior to engagement. The second base member 10A is illustrated in an elevated position relative to the first base member 10. The tongue 60 is disposed on the second side 22 of the first base member 10 whereas the groove 50A is disposed on the first side 22A of the second base member 10A. As the second base member 10A is lowered relative to the first base member 10, the groove 60A of the second base member 10A receives the tongue 50 of first base member 10 to interlock the first and second base members 10 and 10A and to form a water tight seal.

FIG. 11 is an isometric exploded view of the projections 70 of the first base member 10 and the recess 80B of a third base member 10B disposed immediately prior to engagement. The third base member 10B is illustrated in an elevated position relative to the first base member 10. The projections 70 are disposed on the top end 31 of the first base member 10 whereas the recesses 80B are disposed on the bottom end 32B of the third base member 10B. As the third base member 10B is lowered relative to the first base member 10, the recesses 80B of the third base member 10B receive the projections 70 of first base member 10 to interlock the first and third base members 10 and 10B and to form a water tight seal.

Figure 12A:
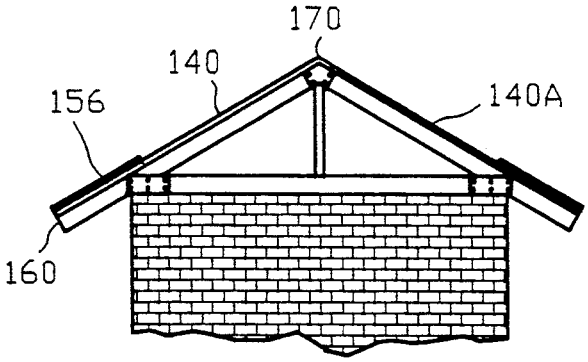
FIG. 12A is an end view of a roofing system illustrating the application of an adhesive means to the roof structure.
Figure 12B:
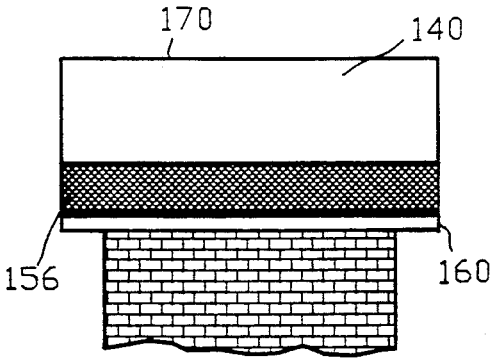
FIG. 12B is a side view of FIG. 12A

FIG. 12A is an end view of a typical roof structure 140 illustrating the first step in the application of a roofing system utilizing the present invention. A vapor impermeable membrane 158 may optionally be first affixed to the roof structure 140. Thereafter, the adhesive 156 is applied along the entire length of an eave 160 of the roof structure 140 with the width of the adhesive 156 being slightly in excess of the width of the base member 10 as shown in FIG. 12B. A similar application of the roofing system is installed on the roof structure 140A on the opposite side of the ridge 170.

Figure 13A:
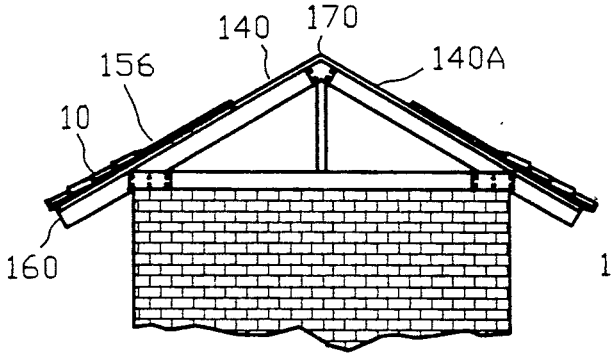
FIG. 13A is an end view of the roofing system illustrating the application two levels of adhesive means and a first level of affixed to the roof structure.

FIG. 13A is an end view of the roof structure 140 illustrating the second step of installing a first course of the base members 10 to the roof structure 140. The bottom end 32 of the base member 10 is disposed proximate the eye 160 of the roof structure 140. The bottom end 32 of the base member 10 is severed to define a planar surface substantially normal to the roof structure 140 and the bottom end 32 is located adjacent to the eve a60. The first base member 10 is affixed to roof structure 140 by adhesively affixing base members 10 to roof structure 140 along the eave 160. The mechanical fastening means 150 further affixes the first base member 10 to roof structure 140 as shown in FIG. 8. The mating plugs 130 are inserted into the cavities 120 following the installation of mechanical fastening means 150.

Figure 13B:
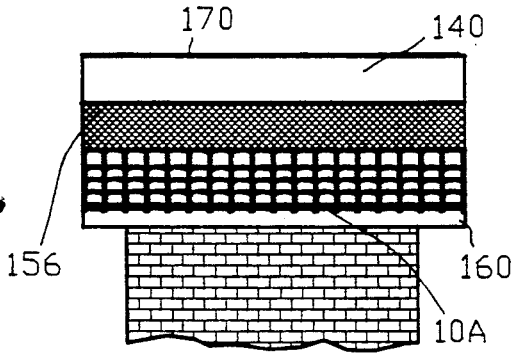
FIG. 13 side view of FIG. 13A.

After the first base member 10 is affixed to roof structure 140, then the second base member 10A is interlocked with the first base member 10 as shown in FIG. 10. The bottom ends 32 and 32A of the first and second base members 10 and 10A are aligned along the eave 160 and with the grooves 60A of the second base member 10A engaging the tongues 50 of first base member 10. The second base member 10A is then affixed to roof structure 140 by the adhesive 156 and the mechanical fastening means 150 in a manner similar to first base member 10. This procedure continues along the total length of eave 160 of roof structure 140 to complete the first level or the first course of base members 10 as shown in FIG. 13B.

Figure 14A:
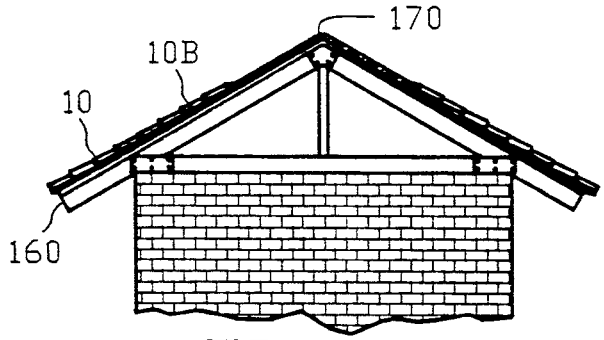
FIG. 14 is an end view of the roofing system illustrating the application of adhesive means over the entire roof surface and two levels of base members affixed to the roof structure.

FIG. 14A is an end view of the roof structure 140 with a second level of adhesive 156 applied to roof structure 140. The installation of the second level or course of base members on roof structure 140 continues with the alignment of the plurality of recesses 80B of the third base member 10B of the second level base members as shown in FIG. 11 with the plurality of projections 70 of the first base member 10 on first level of the base members. The second base member 10B is interlocked with the first base member 10 the plurality of recesses 80B of the third base member 10B engaging with the plurality of projections 70 of the first base member 10.

Figure 14B:
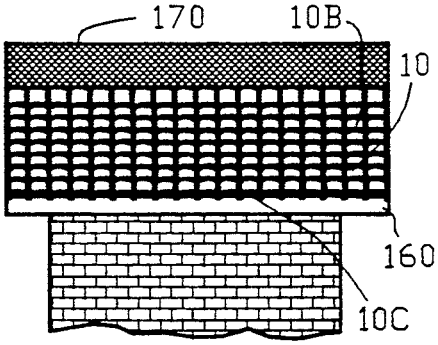

A fourth base member 10C is interlocked with the third base member 10B in a manner similar to FIG. 10 with the grooves of the fourth base member 10C engaging the tongues of the third base member 10B. The fourth base member 10C is also interlocked with the second base member 10A with the plurality of recesses of the fourth base member 10C engaging with the plurality of projections of the second base member 10. This procedure continues along the total length of the roof structure 140 to complete the second level or the second course of base members 10 as shown in FIG. 14B.

Figure 15A:
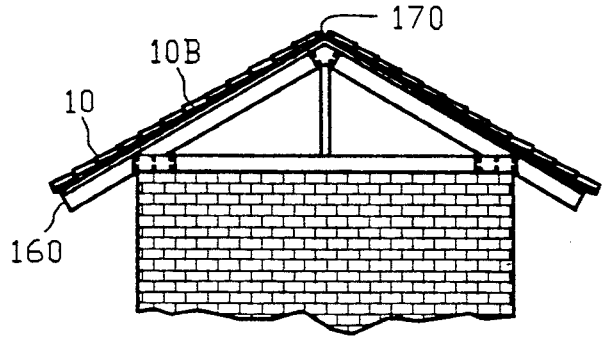
FIG. 15A is an end view of the roofing system illustrating the application of adhesive means and a plurality of base members to the entire roof structure.
Figure 15B:
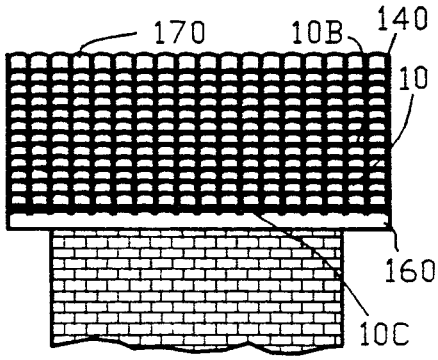
FIG. 15B a side view of FIG. 15A.
Figure 16:
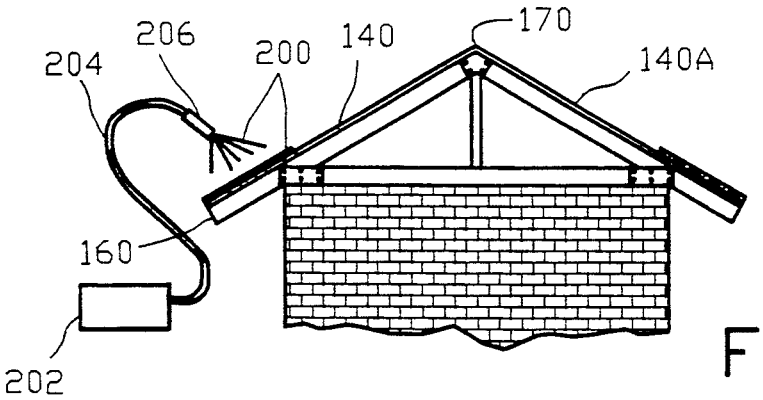
FIG. 16 is an end view of the roofing system illustrating the application of an overcoating of the base members.

FIG. 15A is an end view of the roof structure 140 illustrating the installation process of the third and final level or course of the base members 10. Each of the bases is interlocked with an adjacent base member 10 in a manner similar to FIGS. 10 and 11 with the grooves engaging with the tongues and with the plurality of recesses engaging with the plurality of projections of each of the base members 10. This procedure continues along the total length of the roof structure 140 to complete the final or third level or course of base members 10 as shown in FIG. 15B. When the final or third level or course of base members 10 reach the ridge 170 of roof structure 140, a custom fit trimming, if required, is easily accomplished using a knife, razor, hot knife or the like. Preferably, the base members 10 at the ridge 170 from one side of the roof structure 140 are cut to cooperate with the base members 10 at the ridge 170 from the other side of the roof structure 140A as shown in FIG. 16. The top end 31 of the base member 10 located adjacent to the ridge 170 on the first planar roof structure 140 is severed along a vertical plane whereas the top end 31 of the base member 10 located adjacent to the ridge 170 on the second planar roof structure 140A is severed along a vertical plane. The top end 31 of the base member 10 located on the first planar roof structure 140 abuts the top end 31 of the base member 10 located on the second planar roof structure 140A.

FIG. 16 is an end view of the roofing system illustrating the final step in the installation of the roofing system of the present invention by the application of an overcoating 200 disposed upon the roof structure 140. The overcoating 200 is preferably a modified cement mixture which is pigmented to the desired final color. The overcoating material 200 may also be used as a sealant between adjacent base members 10 such as the interlocking of the tongues 60 with the grooves 50 and the interlocking of the projections 70 with the recesses 80. Furthermore, the overcoating material 200 may also be used as a sealant between the cavities 120 and the mating plugs 130. Reapplication of the overcoating 200 may be accomplished, as desired, to alter the selected roof color or to rectify a breach in the integrity of the monolithic roof. In this embodiment, the overcoating 200 is applied by spraying the modified cement mixture from a source 202 though a hose 204 to be discharged from a nozzle 206. However, various types of coating materials as well as coating methods may be utilized with the present invention.

Figure 17:
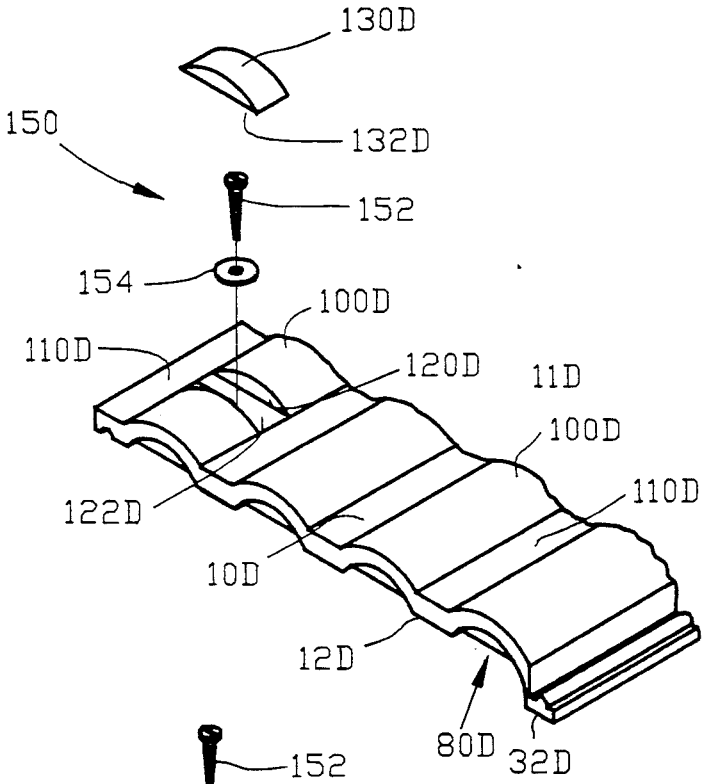
FIG. 17 an isometric detail view of a single cavity mechanical means and a mating plug.

FIG. 17 is an isometric detail exploded view of a second embodiment of a single cavity 120D defined in the tile emulators 100 of the base member 10D. The mechanical fastening means 150 comprises the screw 152, the washer 154 and the mating plug 130. In this embodiment, the bottom cavity surface 122D of the single cavity 120D extends along the same plane defined by the planar areas 110D of the base member 10D. The mating plug 130D includes a planar bottom surface 132D which is engages with the bottom cavity surface 122D in the plane defined by the planar areas 110D of the base member 10D.

Figure 18:
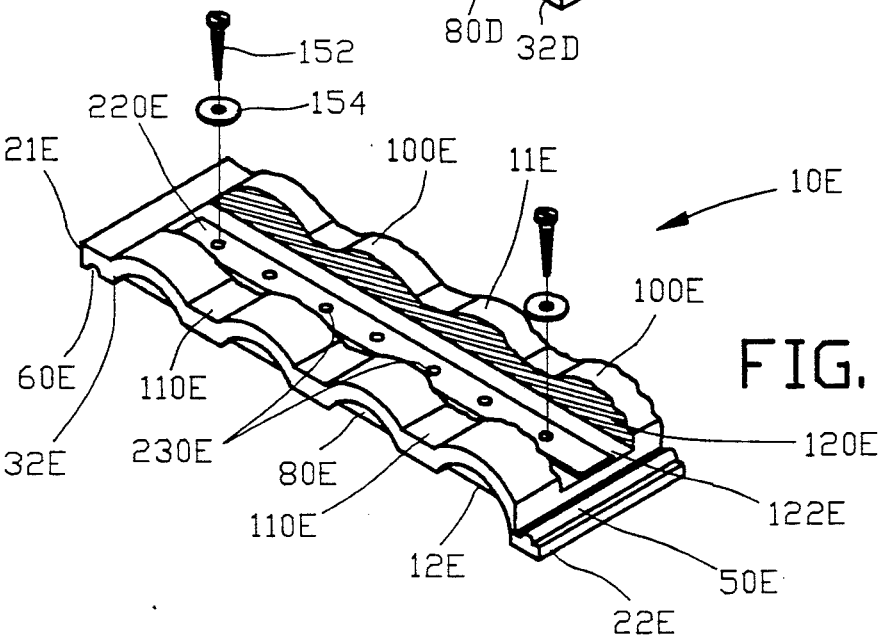
FIG. 18 isometric cut-away detail view or a section of a base illustrating a rigid stringer mechanical fasteners means.

FIG. 18 is a cut away isometric view of a third embodiment of the present invention comprising a plurality of rigid stringers 220E associated with the base member 10E. The rigid stringers 220E are located in alignment with the plurality of cavities 120E disposed substantially central to selected tile emulators 100E. Each of the rigid stringers 220E may be provided with a plurality of apertures or perforations 230E for facilatating insertion of the screws 152. The bottom cavity surface 122E of the single cavity 120E extends along the same plane defined by the planar areas 110E of the base member 10E. The rigid stringers 220E are located on the bottom cavity surface 122E of the base member 10E. The rigid stringers 220E may be set in place during the installation process or may be previously installed to the base member 10E. In another embodiment, the rigid stringers 220E are molded within the base member 10E during the process of forming the base member 10E at a level below the plane defined by the planar areas 110E of the base member 10E. A plurality of mating plugs (not shown) include a planar bottom surface which engages with the bottom cavity surface 122E in the plane defined by the planar areas 110E of the base member 10E.

In this embodiment, the mechanical fastening means comprises the screw 152 and the rigid stringer 220E in combination with the adhesive (not shown). The screws 152 penetrate the apertures or perforations 230E in rigid stringer 220E, the base member 10E and the adhesive (not shown) and further assures structural integrity in high velocity wind conditions. The rigid stringer 220E provide a greater surface area of contact with the base member 10E to increase the strength of the mechanical connection between the base member 10E and the roof structure 140.

Figure 19:
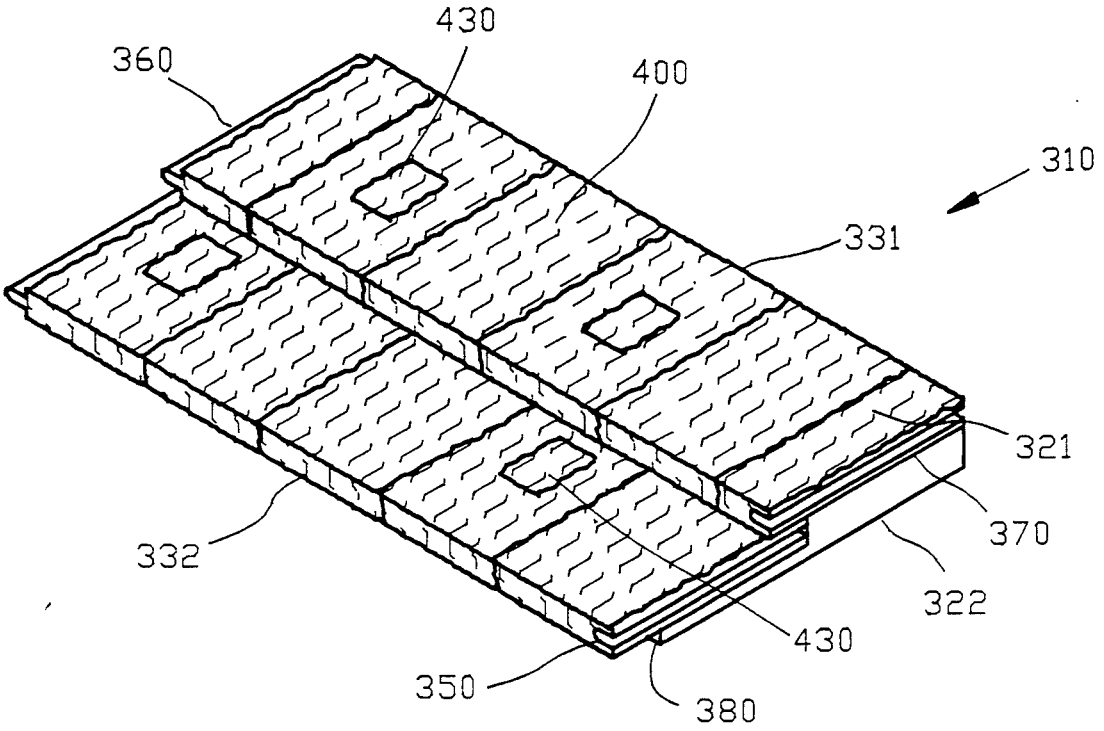
FIG. 19 is an isometric view of a second embodiment of a base member of the improved roof system of the present invention.

FIG. 19 is an isometric detail view of a second embodiment of the rigid base member 310 of the improved roof system of the present invention. The base member 310 has a top surface 311, a bottom surface 312, a first side 321, a second side 322, a top end 331 and a bottom end 332. A groove 350 is disposed on the first side 321 whereas a tongue 360 is disposed on the second side 332 of the rigid base member 310. A plurality of projections 370 are disposed on the top end 331 of base member 310 and a plurality of recesses 380 are located adjacent to the bottom end 332 of the base member 310. The top surface 311 of the base member 310 which is exposed during normal use includes a plurality of tile emulators 400 simulating a conventional shingle roof system or a conventional shake shingle roof system. Preferably, the rigid base member 310 is molded in large sections of a light weight insulating material such as an expanded closed cell plastic foam such as styrofoam or the like to facilitate the installation of a plurality of rigid base members 310 upon a roof structure as well as providing a light weight insulating roof.

The groove 350 disposed adjacent to the first side 321 and the tongue 360 disposed adjacent to the second side 321 of the base member 310 are adapted to interlock with a tongue 360 and a groove 450, respectively, of adjacent base members 310 of identical design to form the roof structure. In a similar manner, the plurality of recesses 380 located at the bottom end 332 of the base member 310 and the plurality of projections 370 located adjacent to the top end 331 of the base member 310 are adapted to cooperate or interlock with the projections 370 and recesses 380, respectively, of an adjacent base member 310 of identical design to form the roof structure.

The base member 310 includes a plurality of cavities (not shown) defined in selected ones of the tile emulators 400 of the rigid base member 310 to receive mechanical fastening means as heretofore described. A plurality of mating plugs 430 are formed for insertion within the plurality of cavities define in the rigid base member 310 in a manner similar to the first embodiment of the invention.

Figure 20:
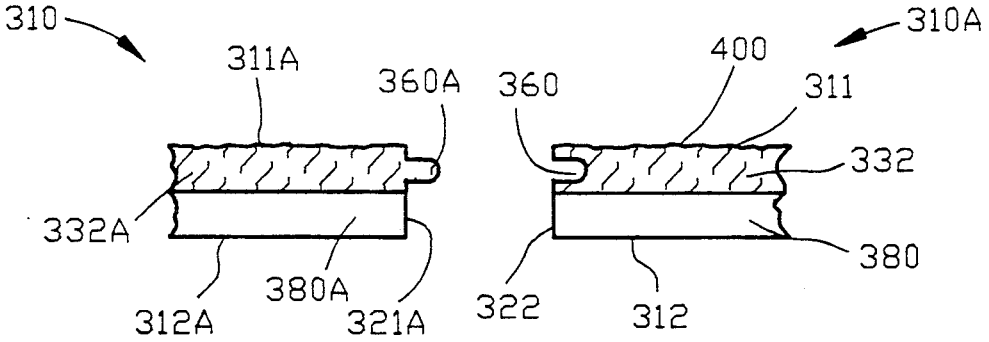
FIG. 20 is a detail view of a tongue and groove means of the second embodiment of the present invention.

FIG. 20 is a side sectional view of plural base members 310 and 310A of the second embodiment of the improved roof system of the present invention. The tongue 360 in the second side 322 of the first base member 310 is receivable in the groove 350A in the first side 421A of the second base member 310A to interlock the first base member 310 to the second base member 310A.

It should be appreciated by those skilled in the art that numerous variation can be utilized in carrying out the present invention. For example, various types of insulating materials may be used for the base member and various types of mechanical fasteners, such as nails, clips, staples and the like may be used to mechanically secure the base members to the roof structure. In addition, numerous types of materials may be selected to provide the overcoating for the base members.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved roofing covering for affixing to a roof structure, comprising in combination;

a plurality of rigid base members;

each of said base members comprising a molded assembly of an expanded closed cell plastic foam for providing a thermal barrier for the roof structure;

each of said plurality of base members being substantially rectangular and having a first side and a second side and a top end and a bottom end;

a groove disposed on each of said first sides of each of said plurality of base members;

a tongue disposed on each of said second sides of each of said plurality of base members;

a recess disposed on each of said bottom ends of each of said plurality of base members;

a projection disposed on each of said top ends of each of said plurality of base members;

affixing means for affixing said plurality of rigid base members to the roof structure with a groove of at least one of said plurality of base members engaging with a tongue of an adjacent one of said plurality of base members and with a projection of at least one of said plurality of base members engaging with a recess of an adjacent one of said plurality of base members; and said affixing means including each of said base members having a plurality of cavities defined in said base member for receiving a plurality of mechanical fasteners positioned in said cavities and penetrating said base member for affixing said base member to underlying roof structure;

a plurality of mating plugs disposed within said plurality of cavities for overlaying said plurality of mechanical fasteners;

a coating overlaying said plurality of base members for sealing said tongue and groove engagements and said projection recess engagements between adjacent base members, and providing protection to the exterior surfaces of said base members; and said coating overlaying said plurality of mating plugs disposed within said plurality of cavities for sealing said plurality of mating plugs with said plurality of cavities and for sealing said plurality of mechanical fasteners therein.

2. An improved roofing system as set forth in claim 1, wherein said coating overlaying said plurality of base members comprises a modified pigmented concrete material.

3. An improved roofing system as set forth in claim 1, wherein said affixing means includes each of said base members having a plurality of rigid stringers interposed in said base member for securing said base member to the roof structure.

4. An improved roofing system as set forth in claim 3, wherein said rigid stringers are metallic stringers.

5. An improved roofing system as set forth in claim 1, wherein each of said base members comprises a plurality of rigid stringers interposed proximate a plurality of bottom cavity surfaces of a plurality of cavities defined in said base member;

a plurality of mechanical fasteners positioned in said plurality of cavities and penetrating said plurality of rigid stringers and said base member for affixing said base member to the roof structure; and a plurality of mating plugs disposed within said plurality of cavities for overlaying said plurality of mechanical fasteners.

6. An improved roofing system as set forth in claim 1, wherein each of said plurality of cavities defining cavity sidewalls and a bottom cavity surface;

each of said plurality of mating plugs defined plug sidewalls, a plug bottom surface and a plug top surface; and said plug sidewalls fictionally engaging said cavity sidewalls of said cavity when said plug bottom surface of said mating plug engages with said bottom cavity surface of said cavity upon insertion of said plug into said cavity.

7. An improved roofing system as set forth in claim 6, wherein each of said base members defines molded surface members defining an exposed surface pattern emulating a tile roof;

each of said plug top surfaces define an exposed surface pattern emulating a tile roof when said plug is inserted into said cavity.

8. An improved roofing system as set forth in claim 1, wherein said bottom end of at least one of said plurality base members is disposed proximate an eve of the roof structure; and said bottom end of at least one of said plurality base members being severed to define a planar surface substantially normal to the roof structure; and said bottom end of said plurality base members being located adjacent to the eve of the roof structure.

9. An improved roofing system as set forth in claim 1, comprising a first base member affixed proximate a first planar roof structure;

said top end of said first base member being severed along a vertical plane;

said top end of said first base member being located adjacent to a ridge of the first planar roof structure;

a second base member affixed proximate a second planar roof structure;

said top end of said base second base member being severed along a vertical plane;

said top end of said second base member being located adjacent to a ridge of the second planar roof structure and with said top end of said first base member abutting said top end of said second base member at the ridge of the first and second planar roof structures.

10. An improved roofing system as set forth in claim 1, wherein said affixing means includes adhesive fastening means.

* * * * *

UNITED STATES PATENT AND TRADEMARK OFFICE

CERTIFICATE OF CORRECTION

PATENT NO. : 5,131,200

DATED : July 21, 1992

INVENTOR(S) : Gordon McKinnon

It is certified that error appears in the above-identified patent and that said Letters Patent is hereby corrected as shown below:

Column 4, line 38, delete "13" and insert therefore --13B is a--.
Column 4, line 39, delete "14" and insert therefore --14A--.
Column 4, line 43, delete "15" and insert therefore --14B--.
Column 4, line 46, after "members" insert --affixed--.
Column 4, line 51, after "17" insert --is--.
Column 4, line 52, after "mechanical" insert --fastening--.
Column 4, line 53, delete "or" and insert therefore --of--.
Column 4, line 54, after "base" insert --member--.
Column 7, line 16, delete "eye" and insert therefore --eve--.
Column 7, line 20, delete "a60" and insert therefore --160--.

Signed and Sealed this

Fourteenth Day of September, 1993

Bruce Lehman

*Attest:*

BRUCE LEHMAN

*Attesting Officer*

*Commissioner of Patents and Trademarks*